US007062789B1

(12) United States Patent
Blackwell

(10) Patent No.: US 7,062,789 B1
(45) Date of Patent: Jun. 20, 2006

(54) OUTDOORS SPORTS APPAREL

(76) Inventor: Jerome L. Blackwell, 17895 E. Ada Dr., Aurora, CO (US) 80017-3229

( * ) Notice: Subject to any disclaimer, the term of this patent is extended or adjusted under 35 U.S.C. 154(b) by 62 days.

(21) Appl. No.: 10/641,837

(22) Filed: Aug. 15, 2003

(51) Int. Cl.
*A41D 13/00* (2006.01)

(52) U.S. Cl. ..... 2/79

(58) Field of Classification Search ..... 2/69, 2/456, 79, 78.2, 227, 114, 408, 228, 238, 2/69.5, 83, 85, 93
See application file for complete search history.

(56) References Cited

U.S. PATENT DOCUMENTS 3,837,007 A * 9/1974 Girest ..... 359/519
4,035,844 A * 7/1977 Atack et al. ..... 2/466
4,128,902 A * 12/1978 Siebert ..... 2/464
4,561,124 A * 12/1985 Thompson ..... 2/23
4,580,297 A * 4/1986 Maejima ..... 2/22
4,894,867 A * 1/1990 Ceravolo et al. ..... 2/238
5,072,454 A * 12/1991 Trahan ..... 2/70
5,649,328 A * 7/1997 Martin ..... 2/238
6,041,437 A * 3/2000 Barker et al. ..... 2/82
6,336,221 B1 * 1/2002 Blauer et al. ..... 2/87
6,477,711 B1 * 11/2002 Freeman et al. ..... 2/69
6,532,599 B1 * 3/2003 Dugan ..... 2/228
6,715,158 B1 * 4/2004 Hay ..... 2/456

* cited by examiner

*Primary Examiner*—Tejash Patel

(57) ABSTRACT

Outdoors sports apparel for protecting the body while participating in winter sports. In particular, a pant including pads for protecting the buttocks and hips from falls incurred while snowboarding. To attain buttock protection, a protective pad arranged from the lower edge of the pant waist across the buttocks. To attain hip protection, said protective pad extending laterally across the hip. In an embodiment, the protective pad comprised of an elastic material. In an embodiment, the pant further comprises a pair of pads, each arranged from the upper edge of the knee to below the knee.

15 Claims, 3 Drawing Sheets

OUTDOORS SPORTS APPAREL

BACKGROUND OF THE INVENTION

1. Field of the Invention

The present invention relates to outdoors sports apparel. In particular, the present invention relates to a pair of sports pants for use in connection with outdoor winter sports. The sports pants have particular utility in connection with protecting the buttocks and hips from falls incurred while snowboarding.

2. Description of the Related Art

Outdoors sports apparel is desirable for keeping one's body protected while partaking in sports activities such as snow skiing or snowboarding.

The use of ski pants is known in the prior art. For example, U.S. Pat. No. 4,580,297 to Mejia discloses a pair of ski pants having a pair of protective pads, where the pads extend from the upper edge of the knee on one of the legs to at least the midportion of the shin. Such protective pads protect the legs from abrasions that may be caused during downhill speed skiing.

U.S. Pat. No. 4,035,844 to Atack et al. discloses a novel trouser-like article of clothing that combines the functions of underwear, socks, garter belts and crotch protectors that may be worn under conventional sporting clothing. However, the Atack et al '844 patent does not pad the buttock or hip area.

Similarly, U.S. Pat. No. 4,128,902 to Siebert discloses a pair of protective gymnast pants that provide pelvic, hip, and thigh area protection by inserting foam inserts into a pouch provided on the front portion of the pants. However, the Siebert '902 patent does not pad the buttock or hip area.

U.S. Pat. No. 4,561,124 to Thompson discloses knee padding for work pants that provides padding over the knees of workpants, where the pad has a self-centering effect within their respective pockets. However, the Thompson '124 patent does not pad the buttock or hip area.

U.S. Pat. No. 4,987,613 to Loverdi et al. discloses an all-in-one slider sport pants that protect from scrapes the thigh and hip area of a softball player sliding into base. However, the Loverdi et al '613 patent does not teach a pad extending from the lower edge of the waist across the buttocks as claimed in the instant application.

Lastly, United States Design Pat. No. 393,141 to Glycenfer appears to disclose a work pant with kneeling pad pockets, wherein the pockets are arranged entirely on the front mid portion of the pants, such that protects kneeling pads may be inserted for use. However, the Glycenfer '141 patent does not appear to pad the buttock or hip area.

While the above-described devices fulfill their respective, particular objectives and requirements, the aforementioned patents do not describe, for example, a pair of sports pants that allows protective padding for the buttocks or hips by teaching a pad extending from the lower edge of the waist across the buttocks as claimed in the instant application. The Maejima '297 ski pant patent makes no provision for protecting the buttocks or hips.

Therefore, a need exists for new and improved sport pants which can be used for snowboarding and skiing. In this regard, the present invention substantially fulfills this need. In this respect, the sport pants according to the present invention substantially departs from the conventional concepts and designs of the prior art, and in doing so provides an apparatus primarily developed for the purpose of protecting the hips and buttocks when falling from skis or snowboards.

SUMMARY OF THE INVENTION

In view of the foregoing disadvantages inherent in the known types of ski pants now present in the prior art, the present invention provides improved outdoors sports apparel, and overcomes the above-mentioned disadvantages and drawbacks of the prior art. As such, the general purpose of the present invention, which will be described subsequently in greater detail, is to provide new and improved outdoors sports apparel which has all the advantages of the prior art mentioned heretofore and many novel features that result in outdoors sports apparel which is not anticipated, rendered obvious, suggested, or even implied by the prior art, either alone or in any combination thereof.

To attain this, the present invention essentially comprises a sport pant comprising a pair of protective pads, where each pad extends from the waist to below the buttocks. An alternate embodiment essentially comprises a trouser-like article of clothing of elastic material having an exteriorly accessible pocket in which the wearer could place a buttock-protecting pad. Still another embodiment essentially comprises a jacket-type article of clothing of elastic material having exteriorly accessible pockets in which the wearer could place elbow-protecting pads.

There has thus been outlined, rather broadly, the more important features of the invention in order that the detailed description thereof that follows may be better understood and in order that the present contribution to the art may be better appreciated.

The invention may also include reflectors. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved outdoors sports apparel that has all of the advantages of the prior art ski pants and none of the disadvantages.

It is another object of the present invention to provide new and improved outdoors sports apparel that may be easily and efficiently manufactured and marketed.

An even further object of the present invention is to provide new and improved outdoors sports apparel that has a low cost of manufacture with regard to both materials and labor, and which accordingly is then susceptible of low prices of sale to the consuming public, thereby making such outdoors sports apparel economically available to the buying public.

Still another object of the present invention is to provide new outdoors sports apparel that provides in the apparatuses and methods of the prior art some of the advantages thereof, while simultaneously overcoming some of the disadvantages normally associated therewith. Still yet another object of the present invention is to provide outdoors sports apparel for increasing the visibility of the wearer.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

Figure 1:
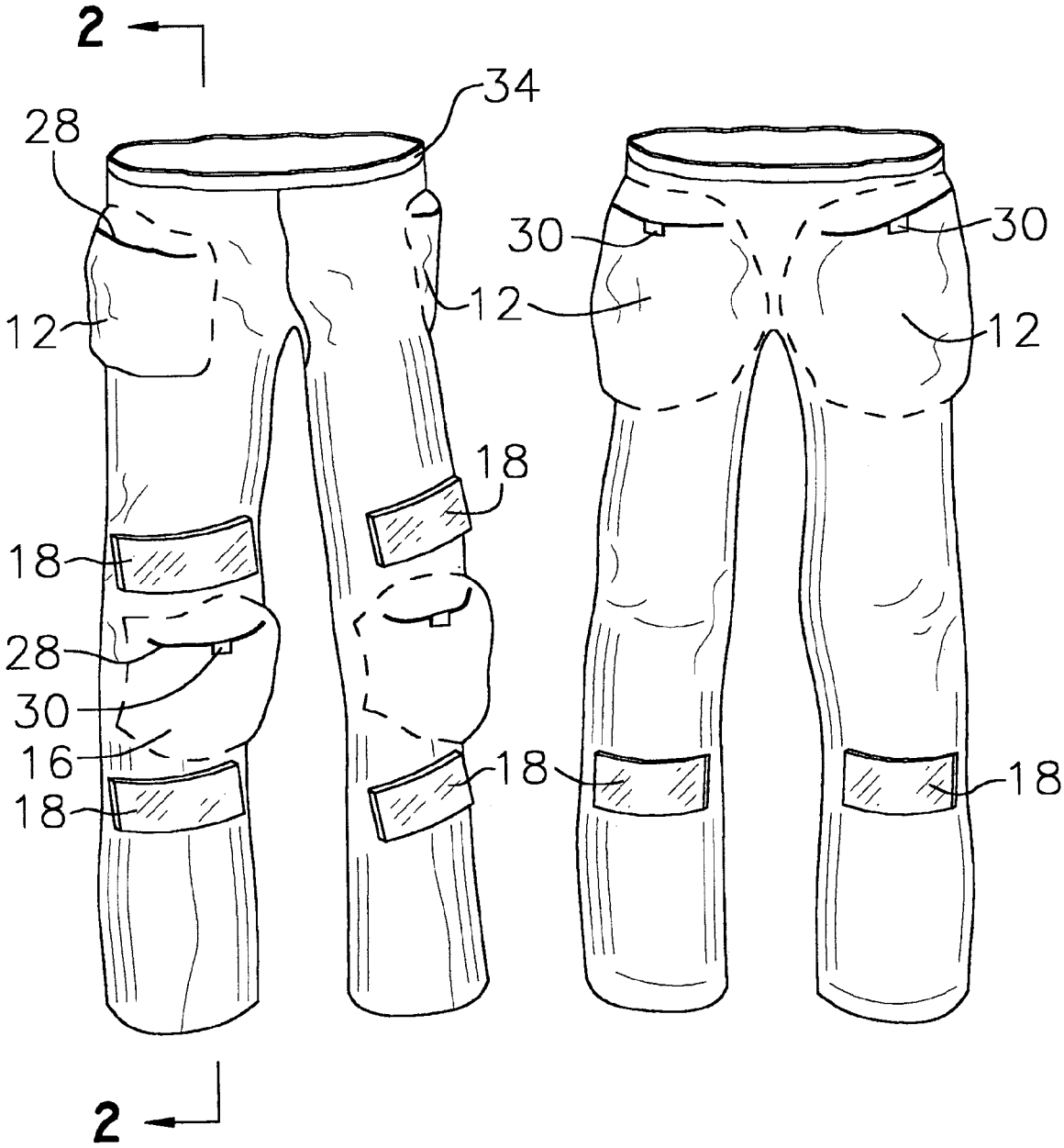
FIG. 1 is a front and back view of an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figure 2:
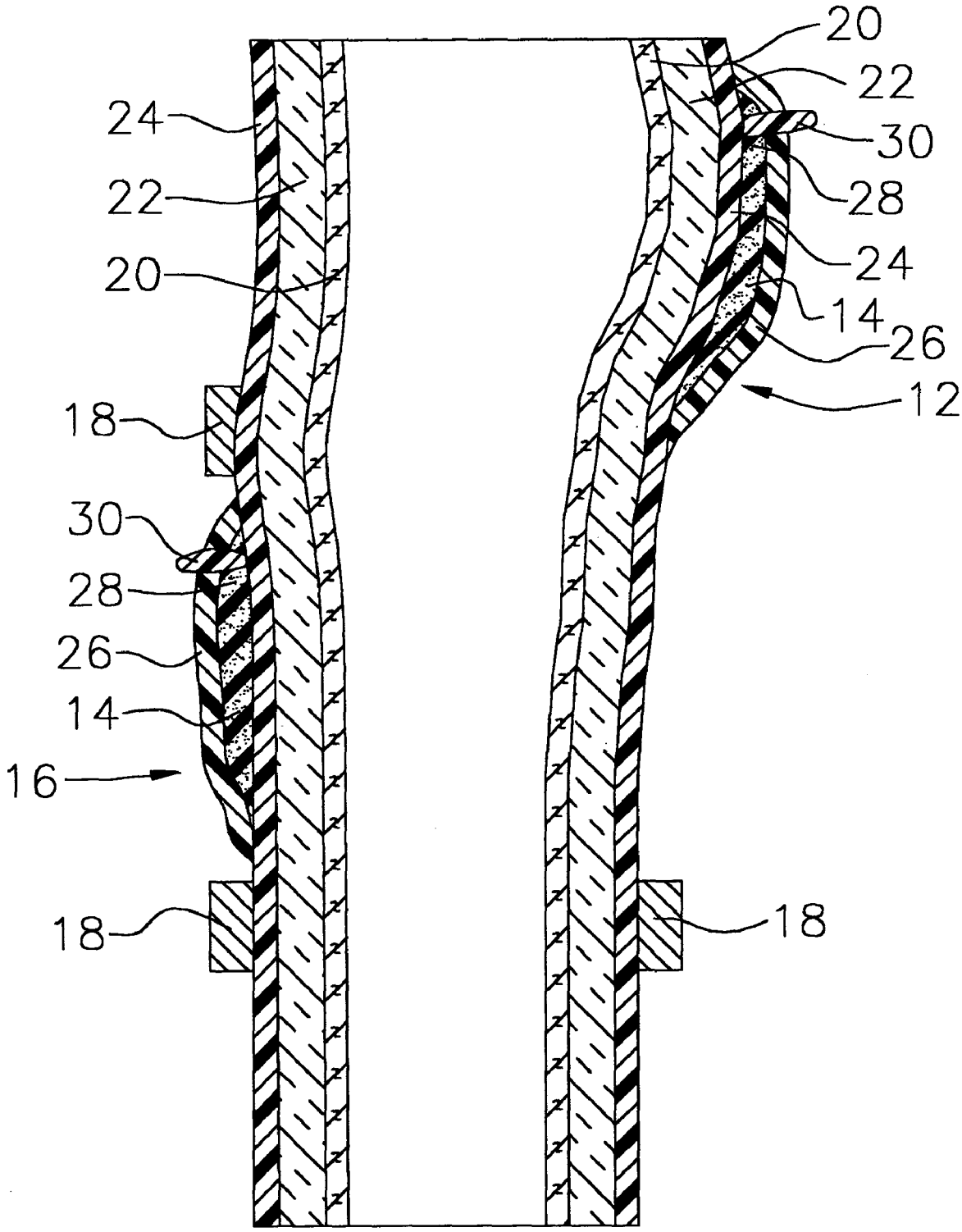
FIG. 2 is a cross-section view of an embodiment of the present invention. The cross-section is taken on line 2 of FIG. 1.
Figure 3:
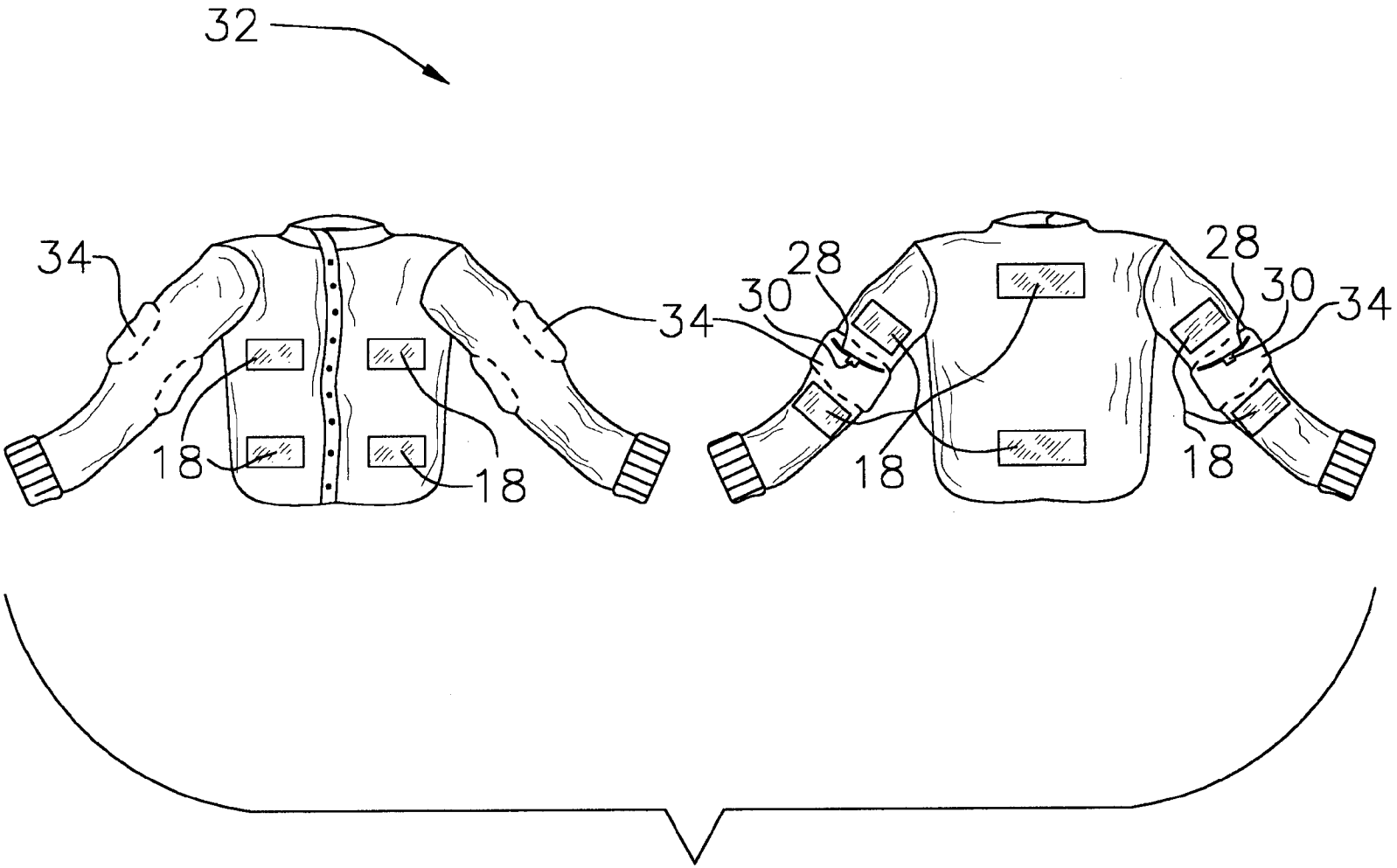
FIG. 3 is a front and back view of an additional embodiment of the present invention.

Referring now to the drawings, and particularly to FIGS. 1–3, a preferred embodiment of the outdoors sports apparel of the present invention is shown. In particular, the sports pants are generally designated by the reference numeral 10, and the sports jacket is generally designated by the reference numeral 32.

In FIG. 1, new and improved outdoors sports apparel of the present invention for protecting the buttocks and hips from falls incurred while snowboarding and snow skiing is illustrated and will be described. Such pants may be constructed to keep a wearer warm and dry. For example, the pants may be waterproof and insulated such that the wearer is protected from the elements. Furthermore, the pants may be constructed such that they are form-fitted to afford greater protection from the elements. The pants may be of a material that stretches in both directions. Further, the pants may afford protection from abrupt falls. More particularly, the sports pants 10 include pads 12. Such pads may be arranged on the backside of the pants 10, and extend from below the waistband 34 to below the buttocks. The pants is sized and cut according to patterns normally used for pants and a left and a right half are joined together at the common seam, as is know in the industry. Elastic material is sewn into the waistband 34 of the pants.

In an embodiment, there may exist one pad for both buttocks. Such a pad could be arranged beneath the outer layer of the pants, and may be sewn into the pants when the left and right half of the outer layer are put together. However, in the preferred embodiment, there may be one pad per buttock configured such that the pad covers entirely its respective buttock. In an embodiment, a pad covers the tailbone of the wearer, such that the tailbone is protected in the event the wearer falls directly on the tailbone. Still further, in alternate embodiments, the pad or pads extend laterally to the front of the pants such that the hip of the wearer is also covered.

In addition to buttock/hip pads 12, the pants 10 may include knee pads 16. Such knee pads are arranged on the front of the sports pants 10, and extend at least from the upper edge of the knee on one of the legs to at least below the knee.

Pads mentioned herein, that is buttock/hip pads 12 and knee pads 16, are formed from an elastic material. For example, such elastic material may be, but is not limited to, high-density rubber or foam. Desirable is material that provides significant cushioning without extraneous bulk. Such pads may be immovably sewn or attached into the pants 10, or they may be placeable and removable by the wearer. Still further, the pads may be placed or removed without removing or reaching within the pants. For example, the pads may be inserted into the pants via pocket openings 28, as shown. That is, the pads may be inserted into pockets integral with the pants. For example, pocket opening 28 may include a hook and loop closure system, and a tab 30. Pulling the tab 30 may open the pocket opening 28. Such a removable pad configuration may be desired, for example, when the pants themselves are machine washable yet the pads are not. Such configuration may also be desirable, for example, so that the pads may be replaced. Further, removable and replaceable pads will allow the wearer to choose pads of a desired thickness.

Pants 10 may also include reflectors 18. As shown, reflectors 18 may be arranged on the front of the sports pants 10 as well as on the back of sports pants 10. In the front, reflectors 18 may be arranged above as well as below the knee pads 16. The rear reflectors 18 may be arranged below the knees. The reflectors 18 may be immovably attached or incorporated into the sports pants 10, or they may be sewn onto or otherwise attached to the sports pants 10. As such, reflectors 18 may be constructed of a variety of reflective materials. Further, some of these reflective materials may be rigid, while others are flexible and/or machine washable. Consequently, such reflectors may allow the wearer to be more easily seen in low visibility conditions. Such reflectors may aid in either finding a wearer in, for example, a snowdrift, or such reflectors may aid in seeing the wearer so as to avoid collisions with, for example, other snowboarders.

Turning to FIG. 2, a cross section taken on line 2 of the embodiment illustrated by FIG. 1 is shown. As shown, sports pants 10 may have a layered construction. For example, sports pants 10 may include inner layer 20 arranged next to the skin. Such inner layer may be a fabric adapted to wick moisture from the skin. Such fabrics may include cotton, silk, or other synthetic fabrics designed for their moisture wicking abilities. Next to this inner layer 10 may be an insulating layer 22. Such insulating layer may be polyfill or the like, or any other natural or synthetic fabric or combinations of fabrics. Next to the insulating layer 22 may be outer layer 24. Outer layer 24 is waterproof in a preferred embodiment. For example, outer layer 24 may be nylon. Pads 16 or 12 may be arranged between the insulating layer and the nylon layer in an embodiment where the pads are not removable. That is, the pads may be arranged beneath the outer layer 24 in an embodiment where the pads are not removable. However, in an embodiment where the pads are removable and replaceable, the pads may be arranged within a pocket formed upon the outer layer 24. Such pocket may be fashioned from a pad-covering layer 26. Such pad-covering layer may be the same material as the outer layer 24, but may not necessarily be the same material.

Turning to FIG. 3, an embodiment of the outdoors sports apparel of the present invention is illustrated and will be described. In particular, a sports jacket 32 is shown. Such a sports jacket may have a layered construction as described for the sports pants 10. Further, such a sports jacket may be constructed of similar fabrics and materials. Sports jacket 32 may include elbow pads 34. Such elbow pads 34 may be arranged on the sleeves of sports jackets 32, configured such that the pads wrap around laterally towards the front of the sleeve. It may be desirable to have removable and replaceable elbow pads 34; therefore sports jacket 32 may include pocket openings 28 and closure means, or tab, 30. Such elbow pads would be arranged such that they could protect the wearer's elbows in the event of a fall. Furthermore, sports jacket 32 may include reflectors 18 as indicated. That is, the sleeves may each include a pair of reflectors, arranged above and below each elbow pad. Further, the back of the jacket may include a pair of reflectors, one arranged on the wearer's upper back, the other arranged on the wearers lower back. Still further, the front of the jackets may include two pairs of reflectors, wherein a pair is arranged on each side of a midline of the jacket. Of each pair, one of the reflectors is arranged across the chest of the wearer, while the other is arranged at the waist of the wearer. Although not shown, the outdoors sporting apparel may also include extra pockets to accommodate articles the wearer may need to stow. Such extra pockets will be arranged on areas that have a lower probability of forceful impact in the event of a fall. Such an area may be, for example, the outside upper arm or the outside lower leg. Such pockets could be designed to accommodate, for example, phones, radios, wallets, ski-goggles or sunglasses, or car keys.

While a preferred embodiment of the outdoors sports apparel has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable water-resistant fabric may be used instead of the nylon outer layer described. And although outdoors sports pants or trousers have been described, it should be appreciated that the outdoors sports apparel herein described is also suitable for use as bib overalls. Furthermore, a wide variety of natural or synthetic fabrics may be used for any of the layers instead of the particular fabrics described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. Sports pants for protecting the body while snowboarding comprising:

a pair of protective pads having opposing sides formed from an elastic material, each pad extending from the lower edge of the waist across one of the buttocks; and a plurality of posterior, openable and reclosable pockets on the exterior surface of the pants, adapted, at the will of the wearer, to retain the protective pads therein, wherein the pockets hold one side of the pads in its entirety against the body and wherein the pants have a layered construction, wherein the pants comprise an inner layer, an insulating layer, and an outer layer, wherein the insulating layer is arranged between the outer layer and the inner layer.

2. The sports pants as recited in claim 1, wherein each of the pads extends laterally across its respective hip.

3. The sports pants as recited in claim 2, wherein said elastic material is selected from the group consisting of foam, plastics, and high-density rubber.

4. The sports pants as recited in claim 3, wherein at least one of the pads extends across the tailbone.

5. The sports pants as recited in claim 4, further comprising a pair of knee pads formed from an elastic material, wherein each of the knee pads extending from the upper edge of the knee on one of the legs to at least below the knee.

6. The sports pants as recited in claim 5, further comprising reflectors, wherein a pair of reflectors is arranged on the front of each pant leg, flanking each knee pad, and wherein a pair of reflectors is arranged on the back of each pant leg, below each knee.

7. The sports pants as recited in claim 6, further comprising additional reflectors, wherein the additional reflectors are arranged on the back of each pant leg, below the knee.

8. The sports pants as recited in claim 1, wherein the pads are arranged between the outer layer and a pad-covering layer, and wherein the outer layer is arranged between the pads and the insulating layer

9. The sports pants as recited in claim 8, wherein the outer layer is waterproof.

10. The sports pants as recited in claim 9, wherein the sports pants further comprise a bib.

11. In a trouser-like article of clothing formed of a material which is elastically stretchable both in the longitudinal and transverse directions, the provision of a posterior, openable and reclosable pocket on the exterior surface of the trouser, adapted, at the will of the wearer, to retain a buttock protector pad having opposing sides therein, wherein the pocket holds an entire portion of one side of the buttock protector pad against a wearer's body and wherein the trouser comprises an inner layer, an insulating layer, and an outer layer, wherein the insulating layer is arranged between the outer layer and the inner layer.

12. The article of clothing recited in claim 11, further comprising an additional pocket such that each pocket is arranged upon one of the wearer's buttocks such that each pocket is adapted to retain a buttock protector pad.

13. The article of clothing recited in claim 11, further comprising a pair of additional pockets such that each pocket is arranged upon one of the wearer's knees such that each pocket is adapted to retain one side of a knee protector pad in its entirety against a wearer's body.

14. The article of clothing recited in claim 13, further comprising closure means to open and close such a pocket.

15. The article of clothing recited in claim 13, further comprising three pairs of reflectors, wherein a pair of reflectors is adapted to be affixed on the front of each pant leg, wherein a reflector is arranged above and below each knee protector pad, and wherein a pair of reflectors is adapted to be affixed to the back of each pant leg, wherein a reflector is arranged below each knee.

* * * * *